US007226317B2

(12) United States Patent
Wada et al.

(10) Patent No.: US 7,226,317 B2
(45) Date of Patent: Jun. 5, 2007

(54) SHIELDED CONNECTOR

(75) Inventors: Yoshimasa Wada, Yokkaichi (JP); Shigekazu Wakata, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 11/635,092

(22) Filed: Dec. 7, 2006

(65) Prior Publication Data

US 2007/0082534 A1 Apr. 12, 2007

Related U.S. Application Data

(62) Division of application No. 11/018,069, filed on Dec. 20, 2004, now Pat. No. 7,147,513.

(30) Foreign Application Priority Data

Dec. 22, 2003 (JP) ..... 2003-425641
Mar. 30, 2004 (JP) ..... 2004-099781
Jun. 11, 2004 (JP) ..... 2004-174049

(51) Int. Cl.
*H01R 9/03* (2006.01)

(52) U.S. Cl. ..... 439/610

(58) Field of Classification Search ..... 439/610, 439/578, 95, 98, 579, 580, 584, 585, 877
See application file for complete search history.

(56) References Cited

U.S. PATENT DOCUMENTS 3,646,496 A 2/1972 Williams
3,775,732 A 11/1973 Frogner
4,059,330 A * 11/1977 Shirey ..... 439/578
4,236,779 A * 12/1980 Tang ..... 439/610
4,399,318 A 8/1983 Waters
4,433,206 A 2/1984 Lewis
4,891,022 A 1/1990 Chandler et al.
5,180,316 A 1/1993 Miller et al.
5,352,126 A * 10/1994 Kuboshima et al. ..... 439/89
5,597,322 A 1/1997 Inaba et al.
5,906,513 A * 5/1999 Peterson et al. ..... 439/607
6,012,950 A 1/2000 Vanbesien
6,186,802 B1 2/2001 Masuda et al.
6,231,392 B1 * 5/2001 van Woensel ..... 439/610
7,064,266 B2 * 6/2006 Wada ..... 174/359
7,147,513 B2 * 12/2006 Wada et al. ..... 439/610

FOREIGN PATENT DOCUMENTS

EP 0 921 603 A1 6/1999
EP 1 006 622 A1 6/2000
JP 8-96919 4/1996

* cited by examiner

*Primary Examiner*—Chandrika Prasad
(74) *Attorney, Agent, or Firm*—Gerald E. Hespos; Anthony J. Casella

(57) ABSTRACT

A shielded connector (A) has a housing (20) for accommodating terminal fittings (40) connected with ends of wires (10). A metallic shielding shell (30) is provided in the housing (20), and a tubular connecting member (50) connects an end of the shield (11) and the shielding shell (30). Thus, the shielding shell (30) can be connected with grounding members of a mating housing when the housing (20) is connected with the mating housing. Thus, it is not necessary to connect the shield (11) with the grounding members in addition to a connecting operation of the housing (20).

9 Claims, 24 Drawing Sheets

SHIELDED CONNECTOR

This application is a divisional of U.S. patent application Ser. No. 11/018,069 filed on Dec. 20, 2004 now U.S. Pat. No. 7,147,513.

BACKGROUND OF THE INVENTION

1. Field of the Invention

The present invention relates to a shielded connector.

2. Description of the Related Art

Japanese Unexamined Patent Publication No. H08-96919 discloses a known shielded conductor path with a plurality of wires surrounded by a tubular shield made of a braided wire. Terminal fittings are connected with ends of the respective wires and are accommodated in a housing. A cable is formed by twisting an end of the shielding member and is branched off from the conductor path. A grounding terminal then is secured to an end of the branched cable and is connected with a grounding member, such as a body or a piece of equipment.

The above-described construction for branching a grounding circuit from a conductor path requires the connection of a grounding terminal and the connection of the housing with a mating housing. Thus the known construction requires several operation steps, and presents poor operational efficiency.

The invention was developed in view of the above problem and an object thereof is to improve operational efficiency.

SUMMARY OF THE INVENTION

The invention is directed to a shielded connector to be connected with a shielded conductor path obtained by surrounding a plurality of wires by a tubular shield made of a braided wire. The connector has a housing for accommodating terminal fittings connected with ends of the wires. A metallic shielding shell is disposed in the housing and surrounds the terminal fittings. The connector also has a connecting means for connecting an end of the shield with the shielding shell. As a result, the shielding shell can be connected with a grounding member of a mating housing when the housing is connected with the mating housing. Accordingly, it is unnecessary to connect the shield with the grounding member in addition to a housing connecting operation.

The housing preferably is molded from resin, and the shielding shell preferably is inserted molded into the housing. Thus, the shielding shell is surrounded at least partly by a unitary matrix of resin. The insert molding achieves fewer assembling steps at an assembling site as compared to a design where a shielding shell is assembled into an already molded housing.

The connecting means may include a metallic connecting tube that is crimped into connection an end of the shield. The shield is made of a braided wire and is easy to deform. The shield can be connected easily and securely with the shielding shell by securing the end of the shield to the metallic connecting tube.

The shielding shell preferably has a tubular connecting portion for connection with the connecting tube. The connecting portion of the shielding shell and the connecting tube are connected with their circumferential surfaces placed one over the other. Thus, a large contact area is ensured and no clearance is defined along the longitudinal direction between the shielding shell and the connecting tube to provide stable shielding.

A cover preferably is mounted on the housing for covering a connecting part of the shielding shell and the connecting means. The cover protects the connecting part of the shielding shell and the connecting means from interference from external matter.

The connecting means may include a shielding jacket formed by braiding metallic fine wires into a substantially tubular shape. A first crimping ring may be arranged on the outer surface of one end of the shielding jacket and may be crimped with the one end of the shielding jacket connected with the end of the shield. A second crimping ring may be arranged on the outer surface of the other end of the shielding jacket and may be crimped with the other end of the shielding jacket fitted on the end of the shield. Thus, the shield can be connected with the shielding shell via the shielding jacket.

The connecting means may be a crimping ring on the outer circumferential surface of the end of the shield and crimped with the end of the shield fitted on the end of the shielding shell. Thus, the shield can be connected directly with the shielding shell. The shielding shell then is mounted into the housing later.

The end of the shield may be secured to the shielding shell by the crimping ring before the shielding shell is mounted in the housing. Thus, it is unnecessary to process an end of the shielded conductor path and connect the shielded conductor path and the shielding shell at an assembling site.

The shielding shell may include a lock resiliently engageable with an engaging portion of the housing. The shielding shell is held mounted in the housing by the resilient engagement of the lock and the engaging portion. Thus, the shielding shell can be mounted to the housing with one touch.

An insulating short-circuit preventing portion preferably surrounds the wires at a side of the housing inward of the shielding shell. Thus, even if a coating of the wire should be peeled off and exposed, an electrical connection of such a conductor with the shielding shell can be avoided by the contact of the conductor with the short-circuit preventing portion.

DETAILED DESCRIPTION OF THE PREFERRED EMBODIMENTS

Figure 1:
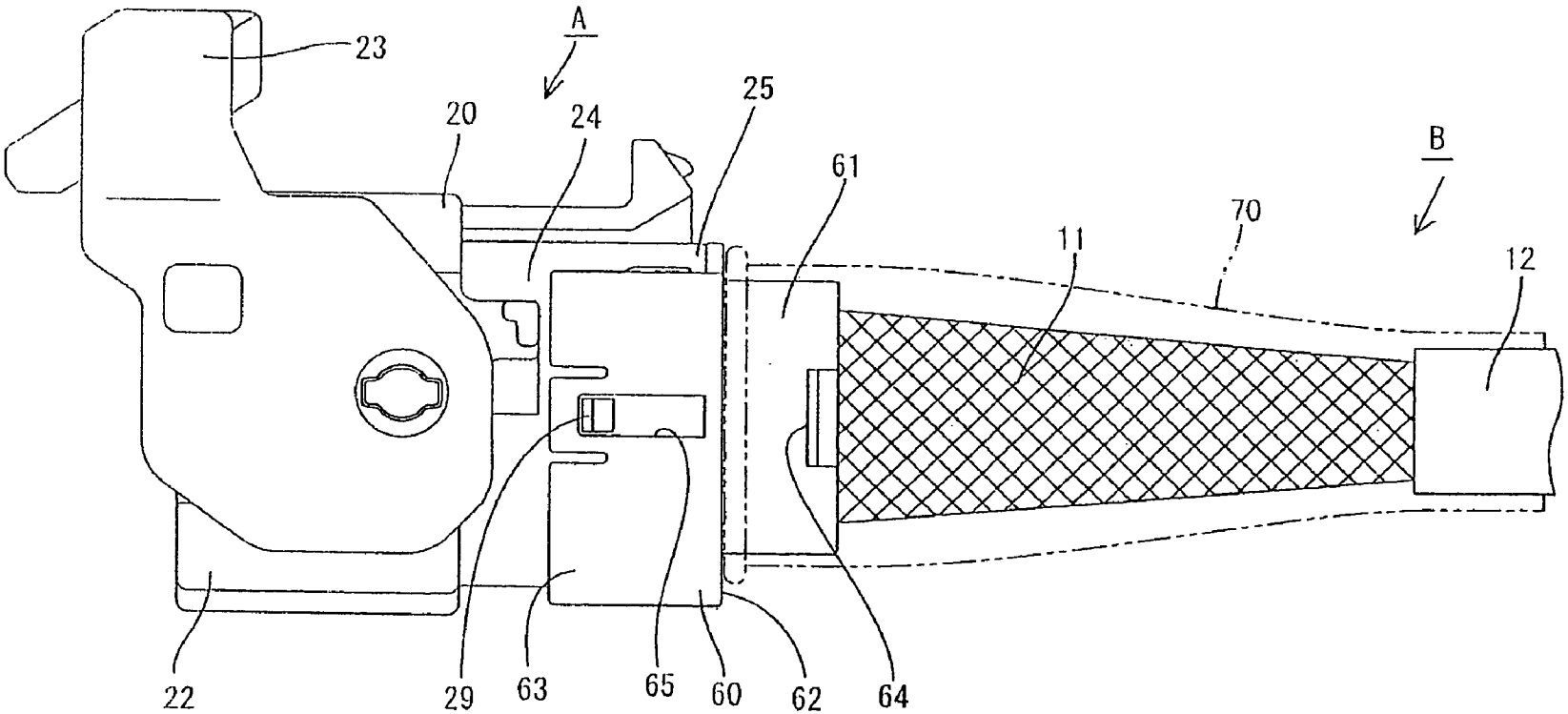
FIG. 1 is a side view of a connector according to a first embodiment.
Figure 2:
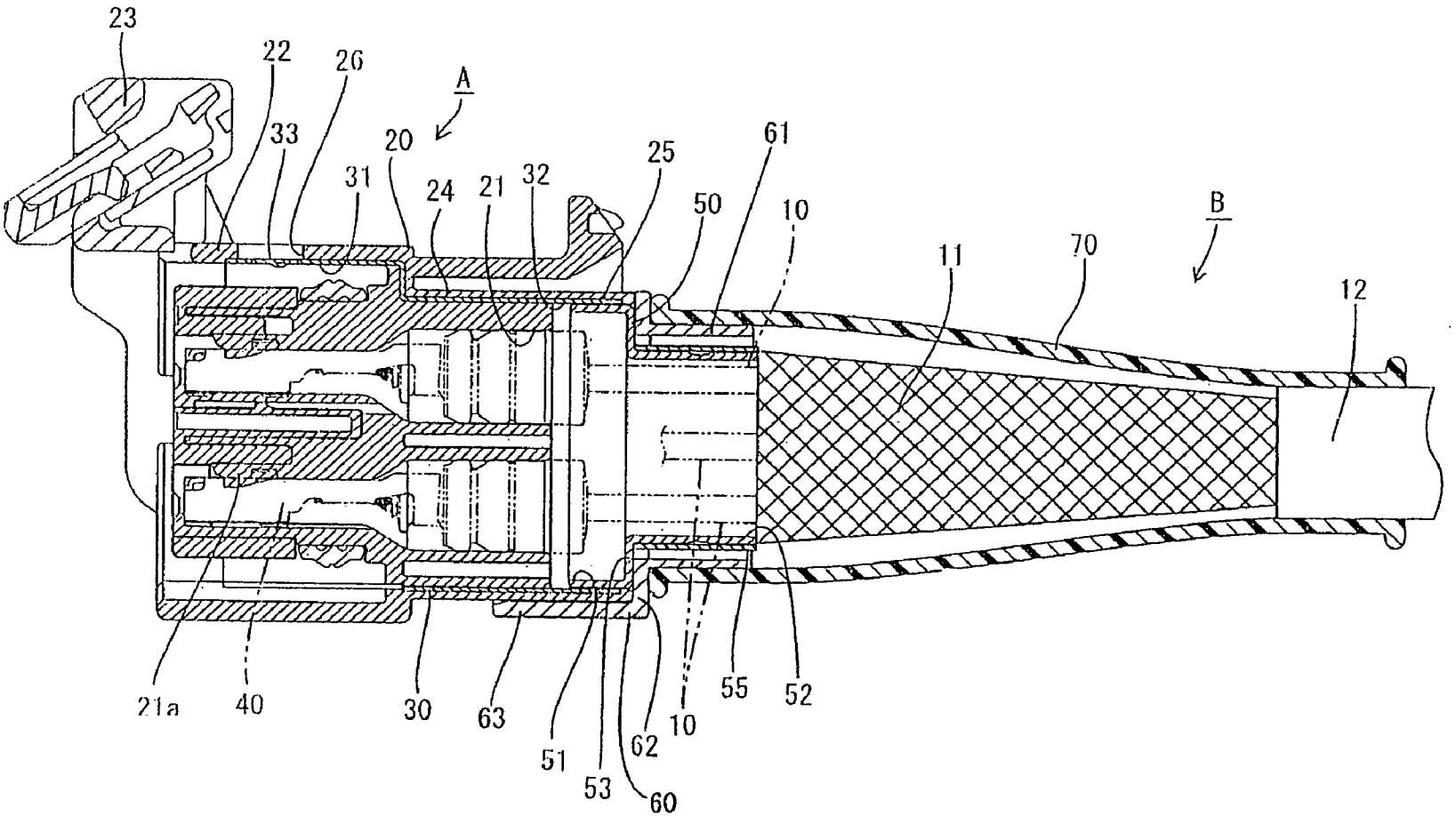
FIG. 2 is a longitudinal section of the connector of FIG. 1.
Figure 3:
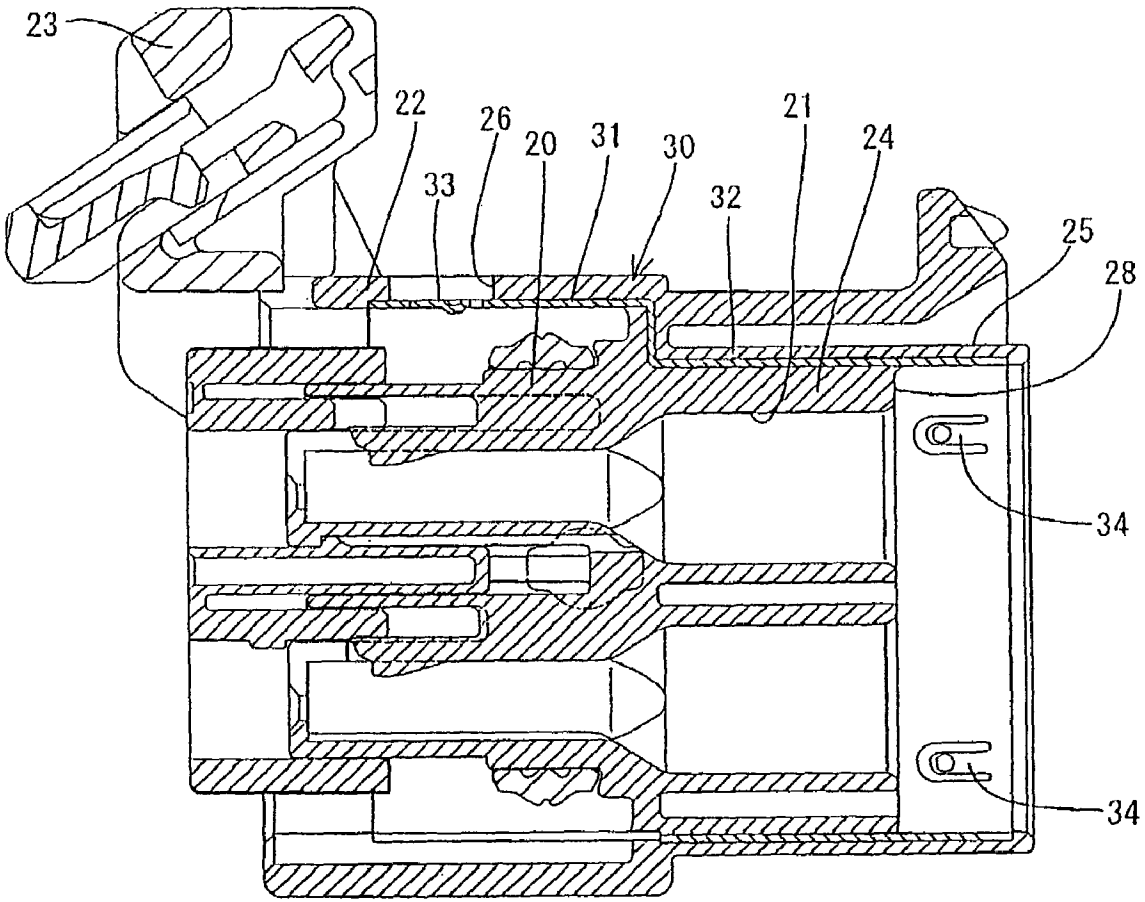
FIG. 3 is a longitudinal section of the housing of the first embodiment.
Figure 4:
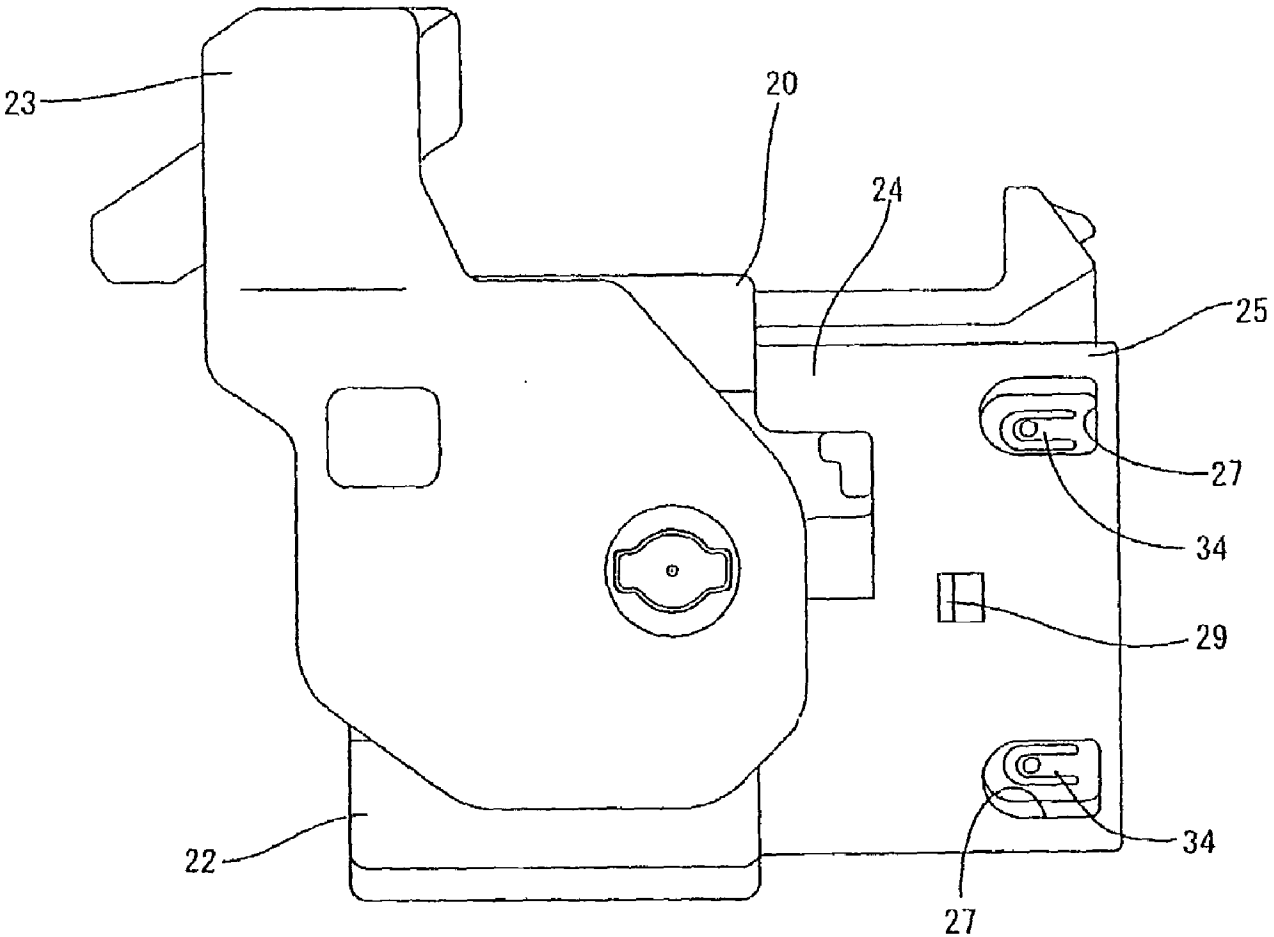
FIG. 4 is a side view of the housing of FIG. 3.
Figure 5:
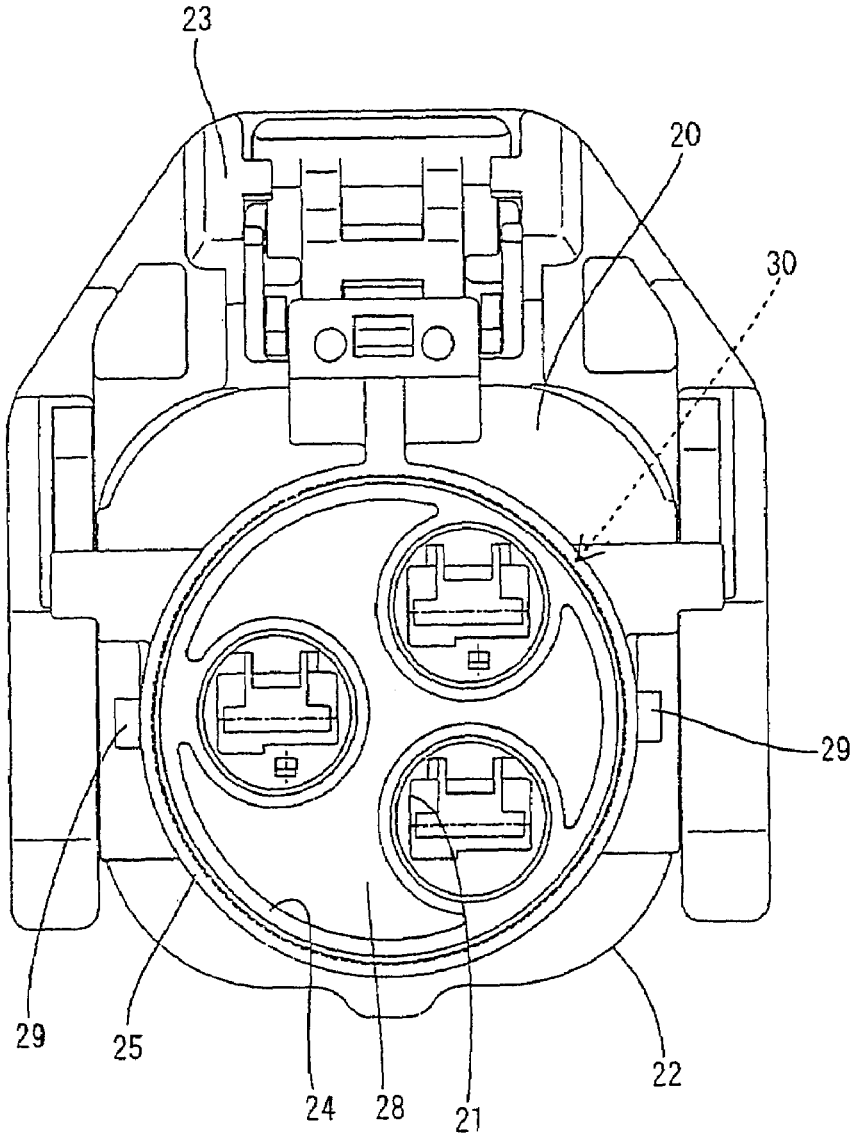
FIG. 5 is a rear view of the housing of FIGS. 3 and 4.
Figure 6:
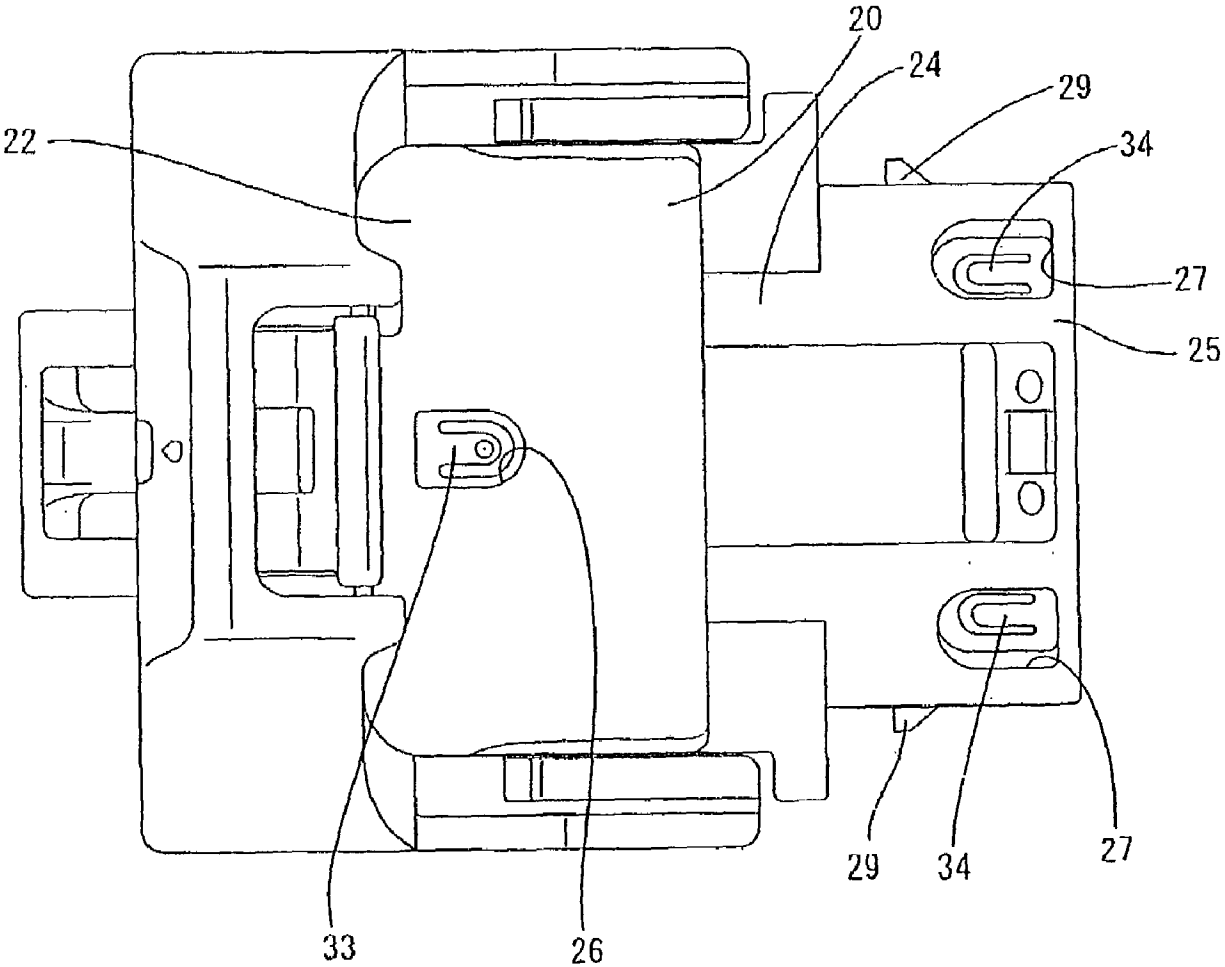
FIG. 6 is top a plan view of the housing of FIGS. 3–5.
Figure 7:
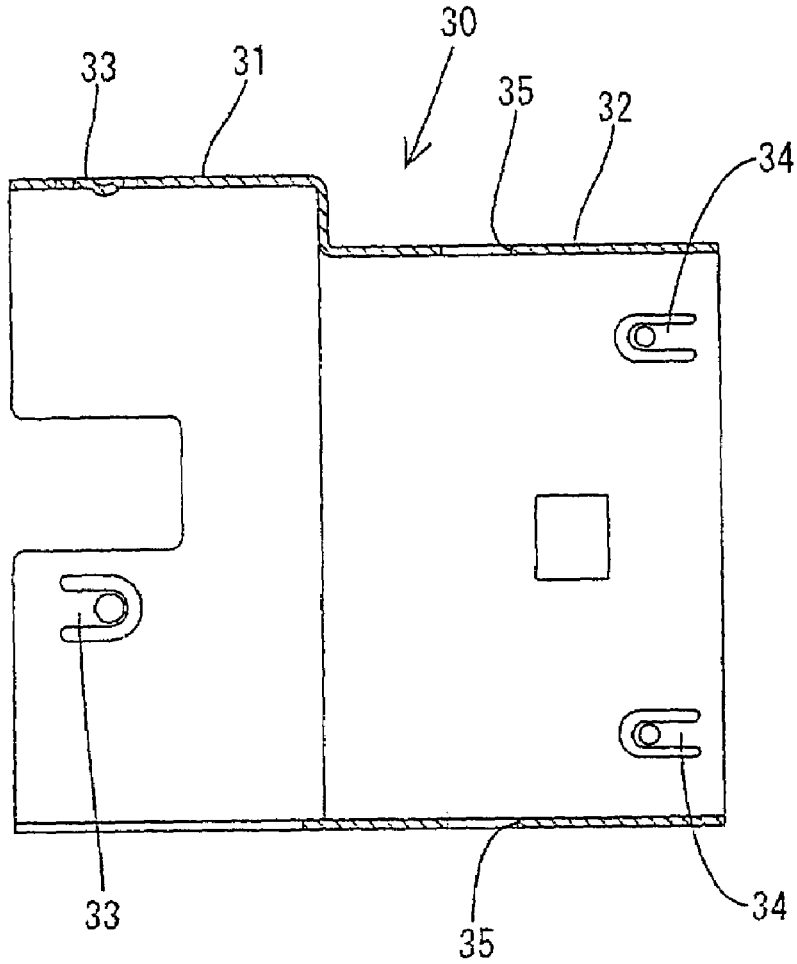
FIG. 7 is a section of the shielding shell of the connector of FIG. 1.
Figure 8:
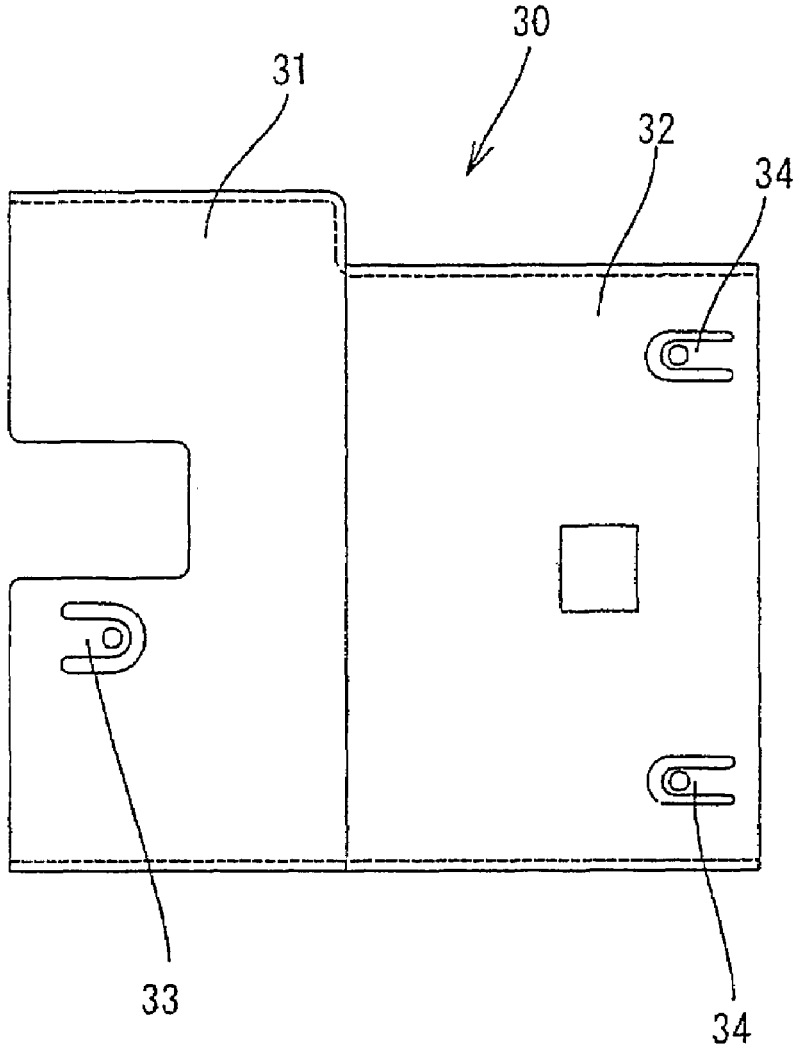
FIG. 8 is a side view of the shielding shell of FIG. 7.
Figure 9:
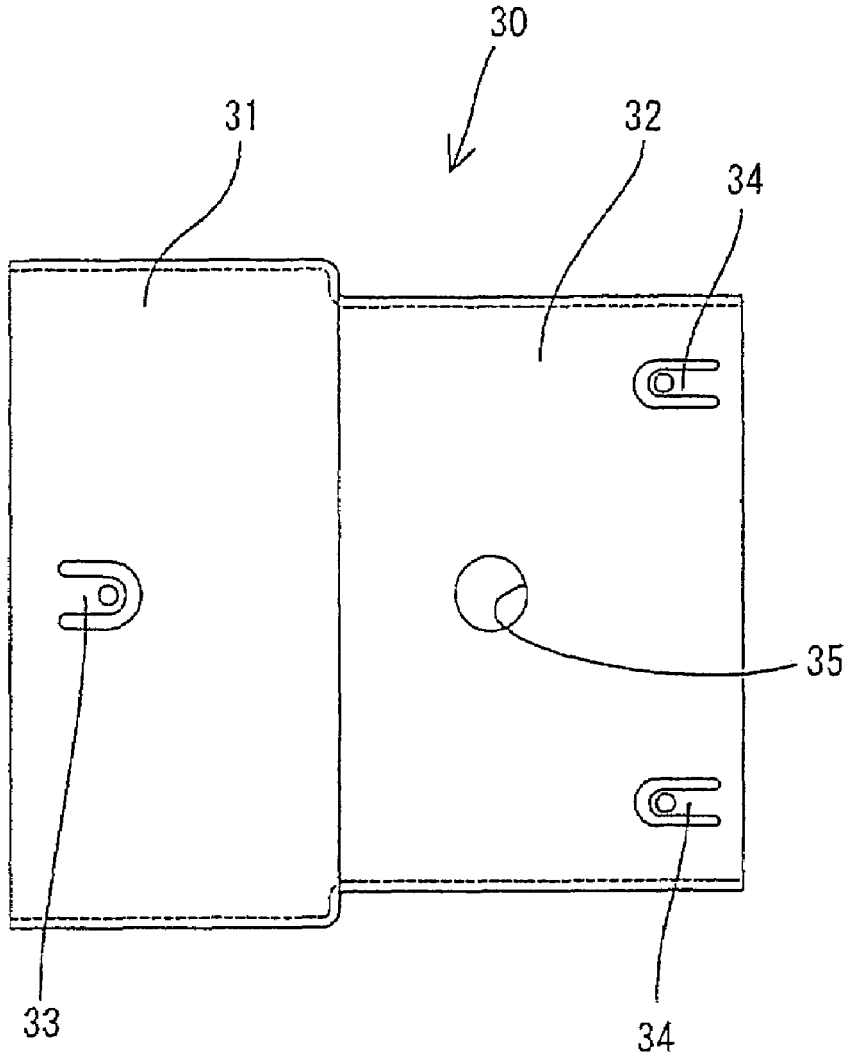
FIG. 9 is a top plan view of the shielding shell of FIGS. 7 and 8.
Figure 10:
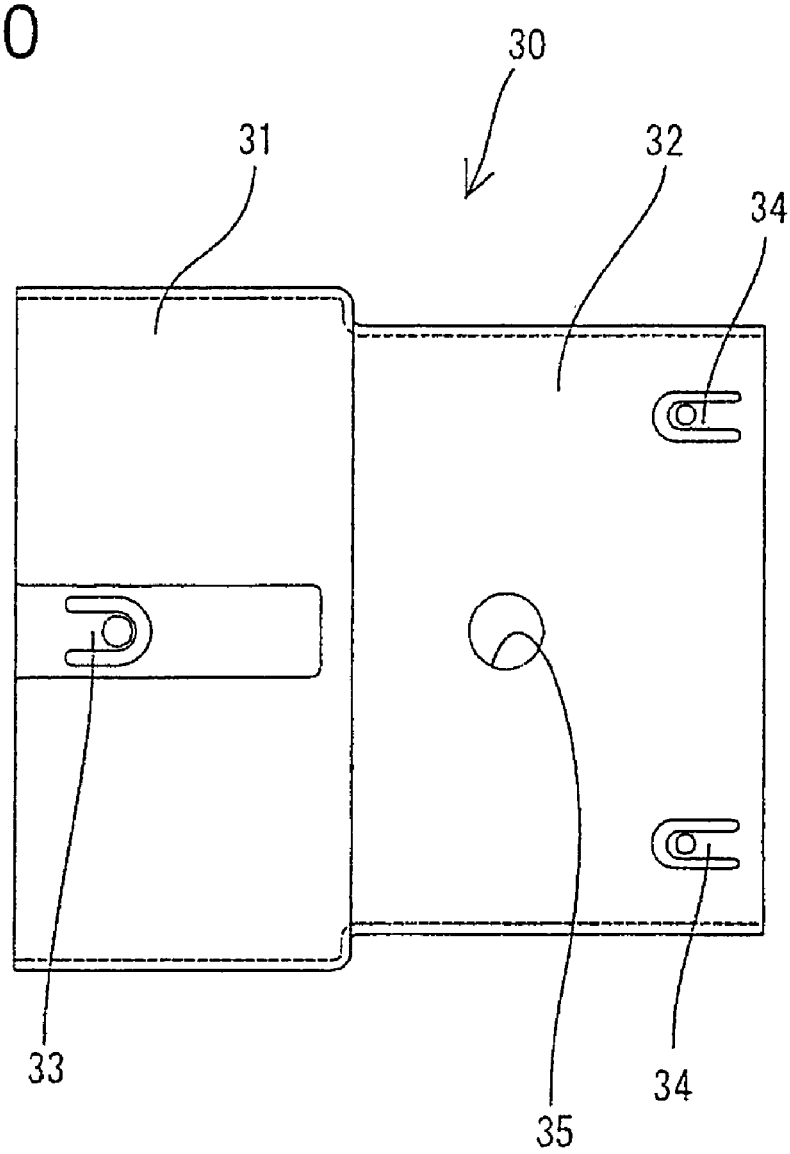
FIG. 10 is a bottom plan view of the shielding shell of FIGS. 7–9.
Figure 11:
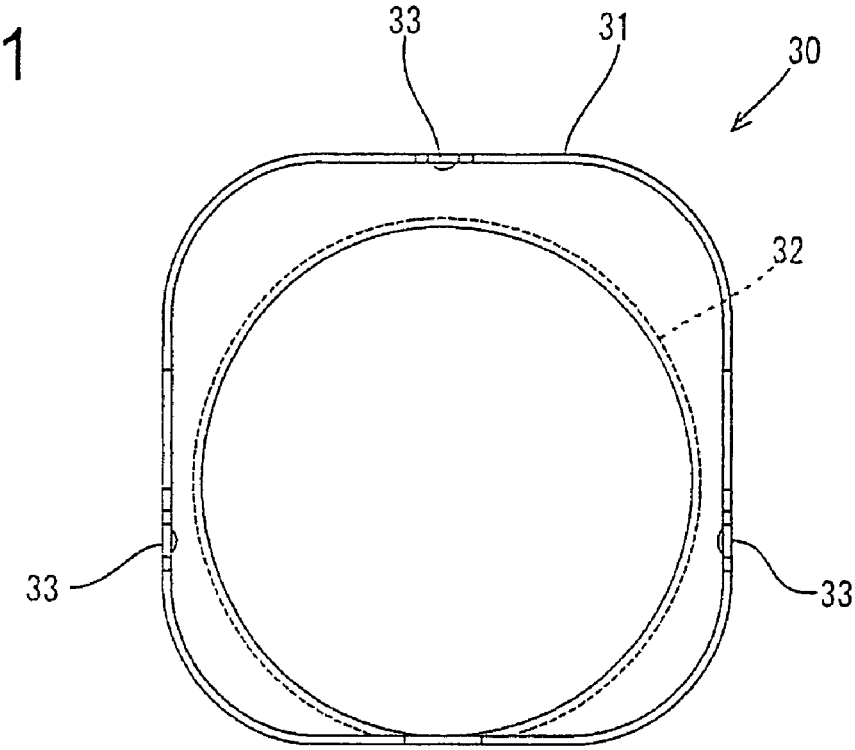
FIG. 11 is a front view of the shielding shell of FIGS. 7–10.
Figure 12:
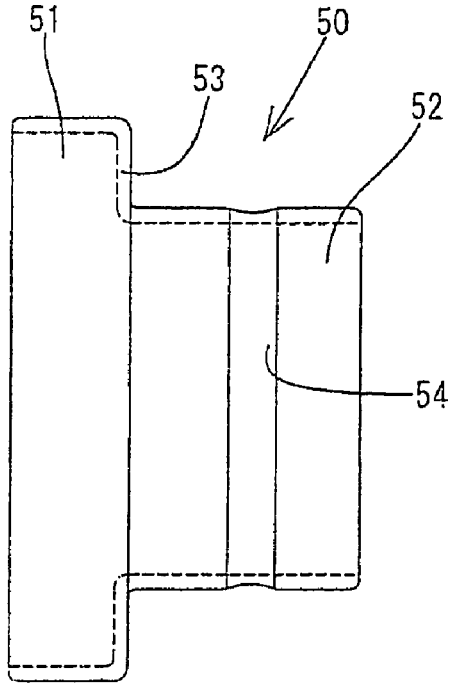
FIG. 12 is a side view of the tubular connecting member of FIG. 1.
Figure 13:
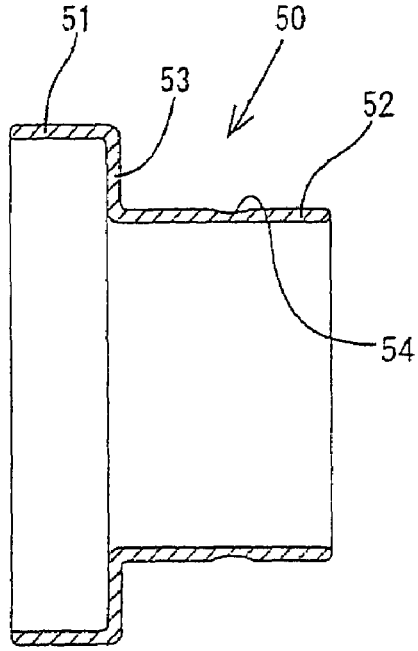
FIG. 13 is a section of the tubular connecting member of FIG. 12.
Figure 14:
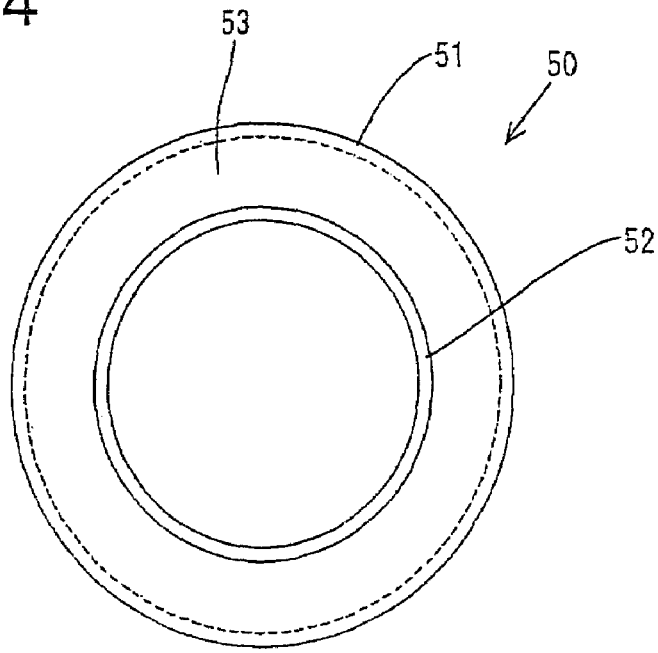
FIG. 14 is a rear view of the tubular connecting member of FIG. 12.
Figure 15:
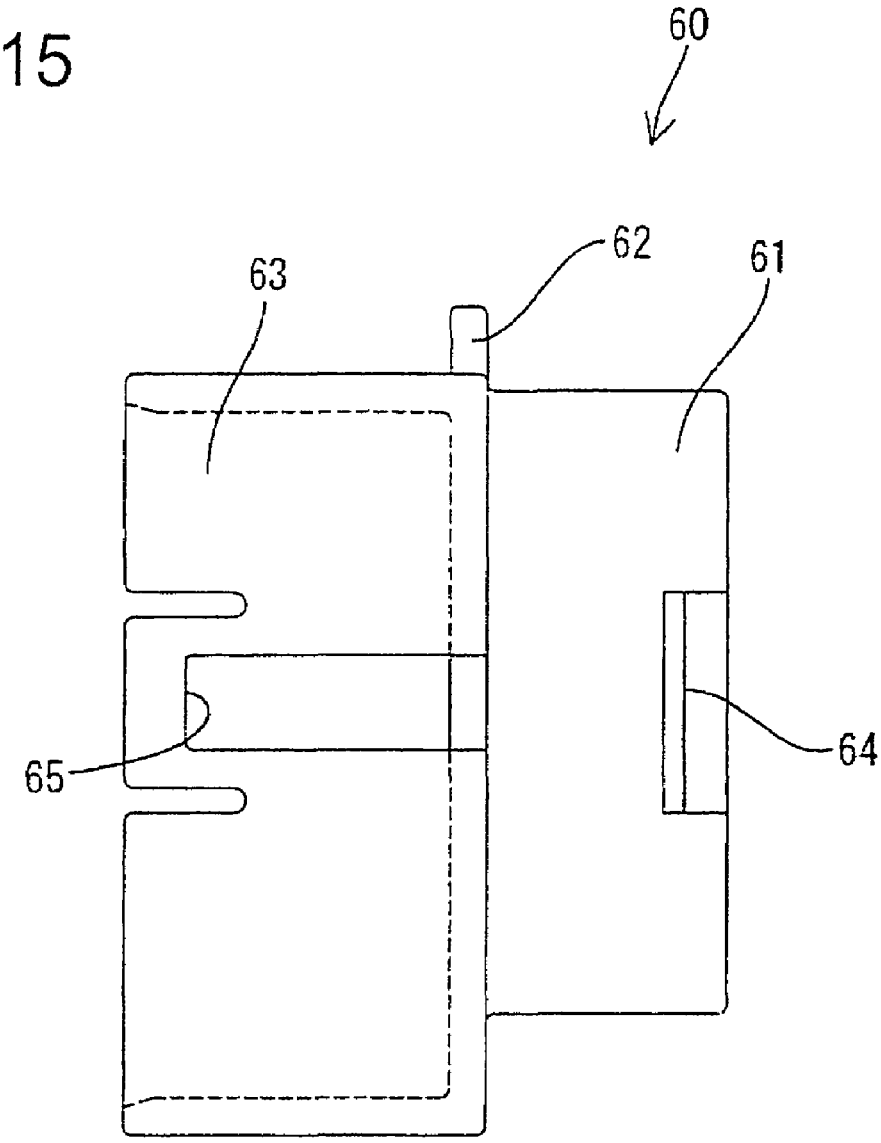
FIG. 15 is a side view of the cover of FIG. 1.
Figure 16:
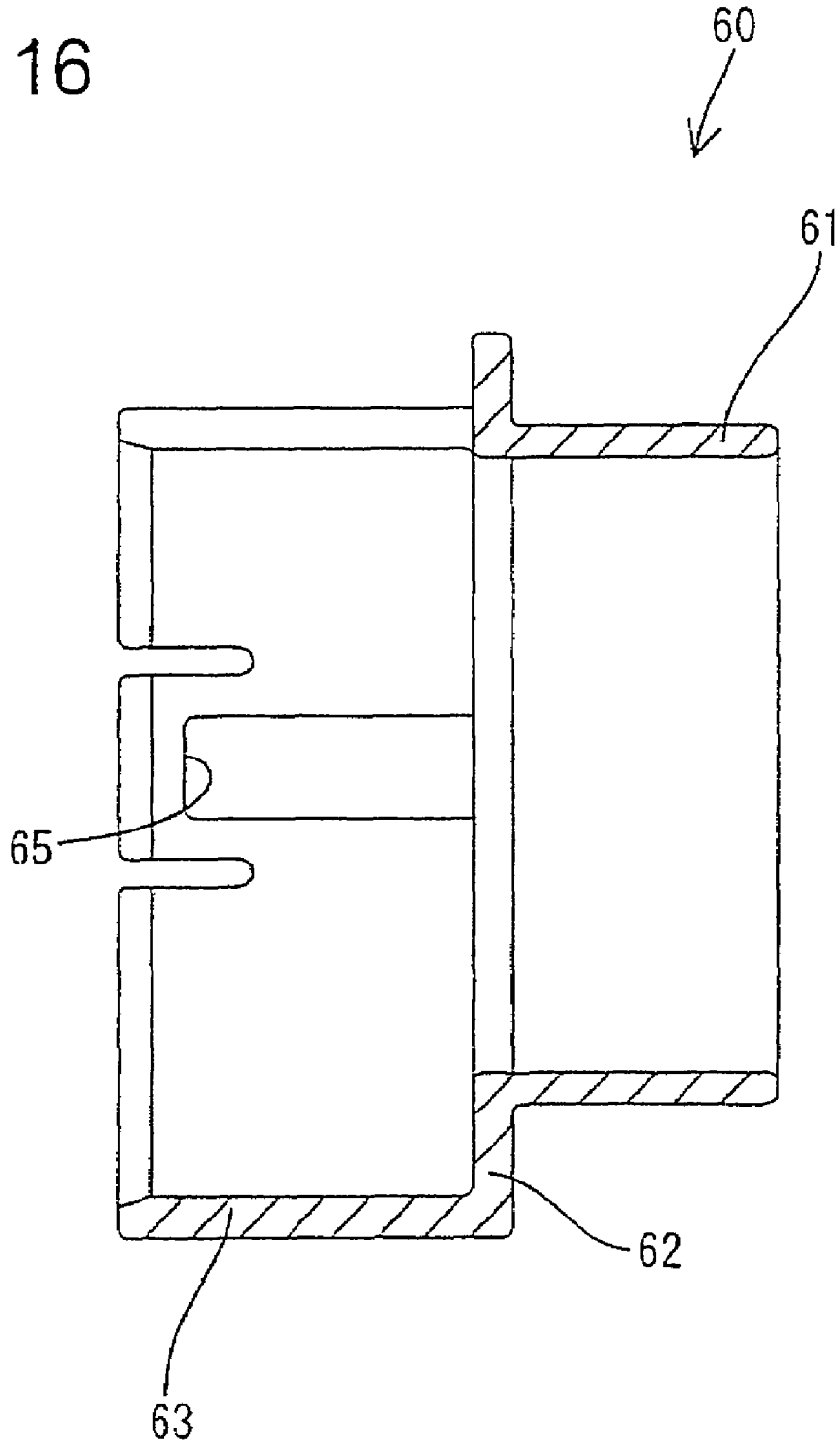
FIG. 16 is a longitudinal section of the cover of FIG. 15.
Figure 17:
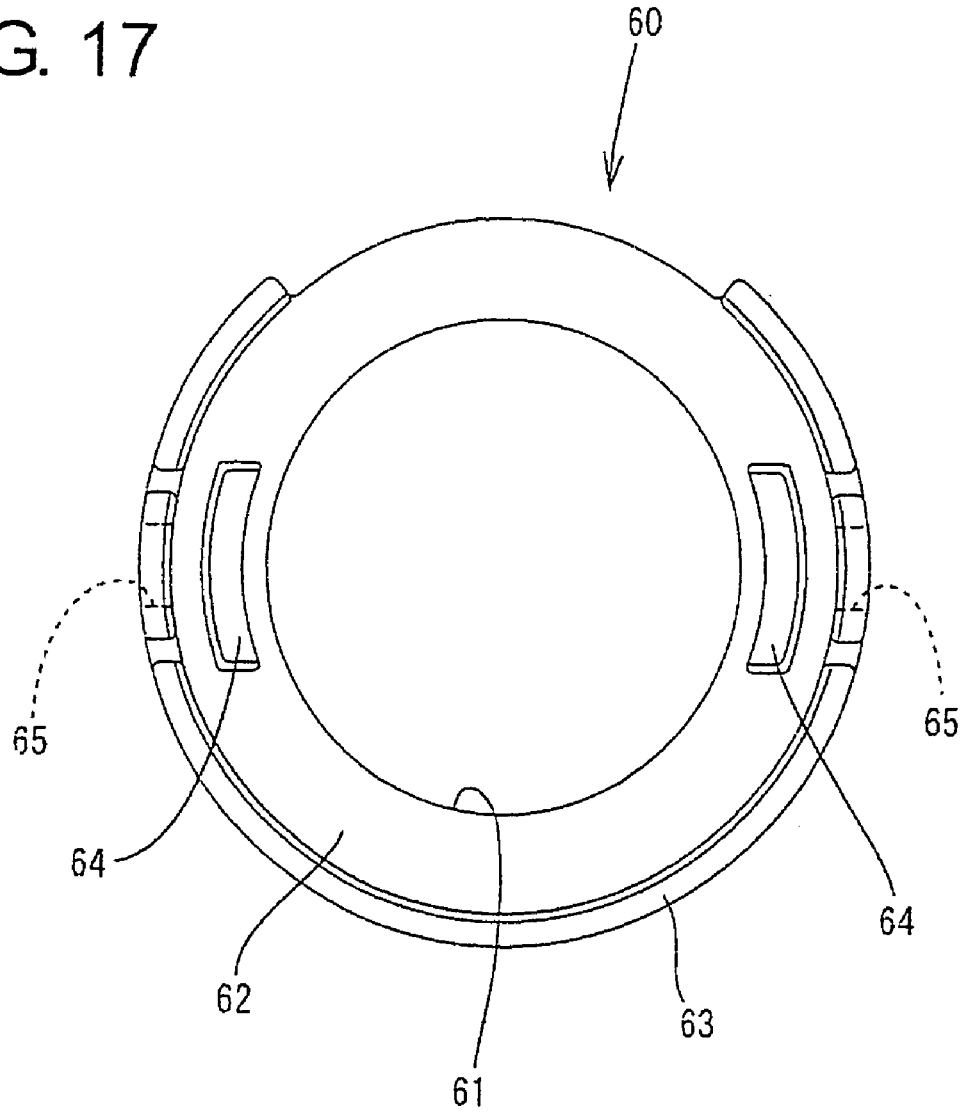
FIG. 17 is a front elevational view of the cover of FIGS. 15 and 16.
Figure 18:
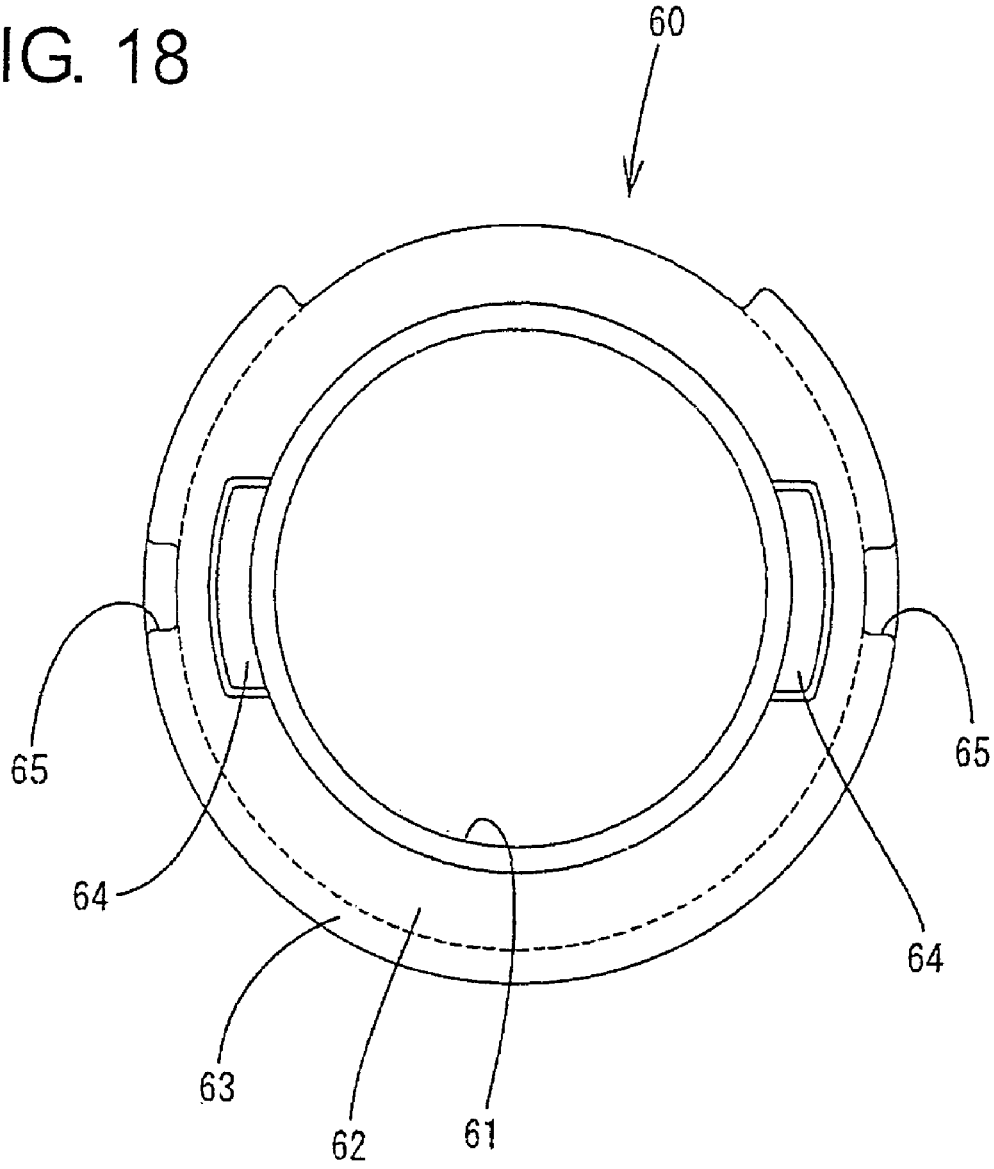
FIG. 18 is a rear elevational view of the cover of FIGS. 15–17.

A shielded connector according to a first embodiment of the invention is identified by the letter A in FIGS. 1 to 18. In the following description, the longitudinal direction and forward and backward directions mean the same.

The shielded connector A is connected with a shielded conductor path B that has wires 10 surrounded by a tubular shield 11. Each wire 10 is a non-shielded wire of known construction with a conductor surrounded by an insulation coating. The shield 11 is formed by braiding fine metal wires into a mesh, and has sufficient flexibility to be extendible both longitudinally and radially. A sheath 12 is mounted on the outer surface of the shield 11.

The shielded connector A is connected with an end of the shielded conductor path B, and has a synthetic housing 20. Three cavities 21 penetrate the housing 20 in forward and backward directions. A substantially rectangular receptacle 22 is formed at substantially the front half of the housing 20, and a gate-shaped lever 23 is supported rotatably on outer surfaces of the receptacle 22. The lever 23 is a known connecting/separating means and facilitates connecting the housing 20 with a mating housing (not shown). A rounded fitting portion 24 is formed at substantially the rear half of the housing 20 and a rounded fitting tube 25 is at the rear end of the fitting portion 24. The fitting tube 25 extends back beyond the rear ends of the cavities 21.

A shielding shell 30 is insert molded during the molding of the housing 20. Thus, part of the shielding shell 30 is surrounded by a unitary matrix of the resin. A substantially front half of the shielding shell 30 is a rectangular tube 31, whereas a substantially rear half is a round tube 32. A step joins the rectangular tube 31 and the round tube 32. Thus, the shielding shell 30 has higher strength and rigidity than a shielding shell with a constant cross section over the entire length. Accordingly, injection pressure generated during insert molding will not deform the shielding shell 30. The upper, left and right plates of the rectangular tube 31 are formed with resilient contacts 33. Additionally, the round tube 32 has four equally circumferentially spaced resilient contact pieces 34 and locking holes 35. The shielding shell 30 is embedded in the housing 20, and parts of the housing 20 enter the locking holes 35 to position and hold the shielding shell 30 in the housing 20.

The rectangular tube 31 is exposed along the inner circumferential surface of the receptacle 22 and surrounds three terminal fittings 40 in the cavities 21. The resilient contact pieces 33 of the rectangular tube 31 resiliently contact grounds (not shown) on the outer circumferential surface of the mating housing. A shielding shell could be assembled into an already molded housing, and the resilient contact pieces would undergo radial resilient deformations because of a clearance between the shielding shell and the housing in view of a tolerance and the like. However, the shielding shell 30 and the housing 20 of this embodiment are held together by insert molding, and space between the shielding shell 30 and the housing 20 normally would not exist to permit resilient deformation of the contact pieces 33. Accordingly, the receptacle 22 is formed with mold-removal holes 26 that are open in the outer surface of the receptacle 22 to prevent material of the receptacle 22 from attaching to the resilient contact pieces 33 during molding in a way that would prevent resilient deformation of the resilient contact pieces 33. Therefore, the resilient contact pieces 33 can deform resiliently in radial directions.

The round tube 32 surrounds the cavities 21 and the fitting portion 24. Additionally, the round tube 32 is concentric with the fitting portion 24. A rear end portion of the round tube 32 is exposed along the inner circumferential surface of the fitting tube 25, and the resilient contact pieces 34 of the round tube 32 are at this exposed part. A shielding shell could be assembled into an already molded housing, and the resilient contact pieces would undergo radial resilient deformations due to a clearance between the shielding shell and the housing in view of a tolerance and the like. However, the shielding shell 30 and the housing 20 of this embodiment are secured together by the insert molding and space normally would not exist for permitting the resilient contact pieces 34 to be deformed in radial directions. Accordingly, the fitting tube 25 of this embodiment has mold-removal holes 27 that open in the outer surface of the fitting tube 25. The mold-removal holes 37 ensure that the material of the fitting tube 25 does not attach to the resilient contact pieces 34 during molding in a way that would prevent the resilient deformations of the resilient contact pieces 34. Therefore, the resilient contact pieces 34 can be deformed resiliently in radial directions.

A female terminal fitting 40 is secured to an end of each wire 10. Each terminal fitting 40 is inserted into the cavity 21 from behind and is locked by a lock 21*a* formed along an inner wall of the cavity 21. The wire 10 extending from the rear end of the terminal fitting 40 is drawn out backward from the housing 20 by way of the fitting tube 25.

A metallic tube 50 connects the shield 11 of the shielded conductor path B with the shielding shell 30. A round large-diameter portion 51 extends longitudinally along substantially the front one-third of the metallic tube 50, and a round small-diameter portion 52 extends along substantially the rear two-thirds of the metallic tube 50 concentric with the large-diameter portion 51. The rear end of the large-diameter portion 51 and the front end of the small-diameter portion 52 are connected by a concentric annular step 53. The outer circumferential surface of the small-diameter portion 52 has a small circumferential recess 54 at a substantially longitudinal middle. The large-diameter portion 51 of the metallic tube 50 is connected with the round tube 32 of the shielding shell 30 by being fitted into the fitting tube 25 of the housing 20.

The connector A further includes a synthetic resin cover 60. A round tubular surrounding portion 61 is formed along a substantially rear half of the cover 60. An annular flange 62 is concentric with the round surrounding portion 61 over the entire circumference and bulges out radially at the front end of the round surrounding portion 61, and an arcuate surrounding portion 63 concentric with the round surrounding portion 61 extends forward from an area of the outer peripheral edge of the flange 62 except an upper end. The arcuate surrounding portion 62 is in a substantially front half area of the cover 60. Left and right catches 64 are formed on the outer circumferential surface of the round surrounding portion 61 for retaining the rubber boot 70 mounted on the cover 60. The arcuate surrounding portion 63 has lock holes 65 for preventing the cover 60 from being disengaged from the housing 20. A rubber boot 70 is mounted to cover the end of the shielded conductor path B, and the front end is fitted on the round surrounding portion 61 of the cover 60.

The shielded conductor path B is processed by removing a specified length end of the sheath 12 at the front to expose the shield 11. A specified length at the front end of the shield 11 then is removed to expose the front ends of the three wires 10. The cover 60 and the round crimping ring 55 then are mounted in this order on the shield 11 from the front, and this assembly is kept on standby at a rear position. The metallic tube 50 is mounted on the three wires 10 from the front, and the small-diameter portion 52 thereof is inserted into a clearance between the wires 10 and the shield 11 to slide the crimping ring 55 forward. As a result, the front end of the shield 11 is held between the small-diameter portion 52 of the metallic tube 50 and the crimping ring 55. The crimping ring 55 then is crimped so that the front end of the shield 11 is squeezed between the small-diameter portion 52 and the crimping ring 55 and so that the shield 11 is caught in the recess 54. In this way, the small-diameter portion 52 of the metallic tube 50 is secured electrically to the front end of the shield 11. The metallic tube 50 then is retracted back and the shield 11 is deformed to contract along the longitudinal direction. The terminal fittings 40 then are connected with the front ends of the respective wires 10 to complete the end processing of the shielded conductor path B.

The terminal fittings 40 are inserted into the cavities 21 and the metallic tube 50 then is slid forward to fit the large-diameter portion 51 of the metallic tube 50 into the fitting tube 25 at the rear end of the housing 20. The front end of the large-diameter portion 51 contacts a back end surface 28 of the fitting tube 25 to stop the metallic tube 50 at its front end position. The large-diameter portion 51 fit into the fitting tube 25 radially overlaps the round tube 32 of the shielding shell 30 along its inner circumferential surface. Thus, the outer circumferential surface of the large-diameter portion 51 and the inner circumferential surface of the round tube 32 are opposed to each other. Additionally, the resilient contact pieces 34 of the round tube 32 are brought resiliently into contact with the outer circumferential surface of the large-diameter portion 51. As a result, the metallic tube 50 is connected electrically with the shielding shell 30, i.e. the shield 11 and the shielding shell 30 are connected electrically with each other.

The cover 60 is slid forward from the standby position to fit the arcuate surrounding portion 63 of the cover 60 on the fitting portion 24 and the fitting tube 25 of the housing 20 without radial shaking. The flange 62 of the properly assembled cover 60 contacts the rear end of the fitting tube 25 to stop the cover 60 at its front end position. Additionally, the front edges of the lock holes 65 of the cover 60 engage lock projections 29 of the housing 20 from the front. As a result, the cover 60 is prevented from coming backward out of the housing 20 and is locked into the housing 20.

The metallic tube 50 and the cover 60 could be assembled beforehand and then slid forward and assembled into the housing 20. The metallic tube 50 then could be inserted into the fitting tube 25 in a stable posture while being guided by the cover 60.

With the cover 60 assembled, the annular portion 53 of the metallic tube 50 contacts the flange 62 of the cover 60 from the front to prevent the metallic tube 50 from coming back out of the housing 20. The large-diameter portion 51 of the metallic tube 50 can move forward and back in the fitting tube 25 between the back end surface 28 and the flange 62 of the cover 60. The round surrounding portion 61 of the cover 60 surrounds the small-diameter portion 52 of the metallic tube 50 projecting back from the housing 20 and is spaced radially from the small-diameter portion 52.

The rubber boot 70 was fit on the shielded conductor path B before and is slid forward after the cover 60 is assembled. Thus, the front end of the rubber boot 70 fits closely on the round surrounding portion 61 of the cover 60. In this state, the catches 64 on the round surrounding portion 61 catch the inner circumferential surface of the front end of the rubber boot 70 to prevent the rubber boot 70 from being detached backward from the cover 60. The rubber boot 70 surrounds portions of the shield 11 that were exposed by removing the sheath 12. Tape (not shown) is applied from the rear end of the rubber boot 70 to the sheath 12 to provide a watertight seal between the rear end of the rubber boot 70 and the shielded conductor path B. In this way, the connection of the shielded conductor path B and the shielded connector A is completed.

As described above, the shielded connector A has the housing 20 for accommodating the terminal fittings 40. The metallic shielding shell 30 in the housing 20 surrounds the terminal fittings 40 and the metallic tube 50 connects the end of the shield 11 and the shielding shell 30. Thus, it is not necessary to connect the shield 11 with the grounding members in addition to connecting the housing 20. The shielding shell 30 is connected with the grounding members of the mating housing when the housing 20 is connected with the mating housing.

The shielding shell 30 is formed integral to the housing 20 by insert molding. Thus, the number of operation steps at an assembling site can be reduced as compared to a construction in which a shielding shell is assembled into an already molded housing.

The connecting means for connecting the shield 11 and the shielding shell 30 is comprised of the crimping ring 55 and the metallic tube 50 to which the end of the shield 11 is crimped. This construction reflects the ease of deforming the braided wire of the shield 11. Secure connection with the shielding shell 30 is made easily by securing the end of the shield 11 to the metallic tube 50.

The round tube portion 32 of the shielding shell 30 connects with the metallic tube 50. Additionally, the round tube 32 of the shielding shell 30 and the large-diameter portion 51 of the metallic tube 50 are connected with the circumferential surfaces thereof placed one over the other. As a result, a large contact area is ensured and no clearance is defined between the shielding shell 30 and the metallic tube 50 to provide a stable shielding performance.

The cover 60 is mounted on the housing 20 and covers the connecting part of the shielding shell 30 and the metallic tube 50. Thus, the connecting part of the shielding shell 30 and the metallic tube 50 are protected from interference with external matter or the like.

Figure 19:
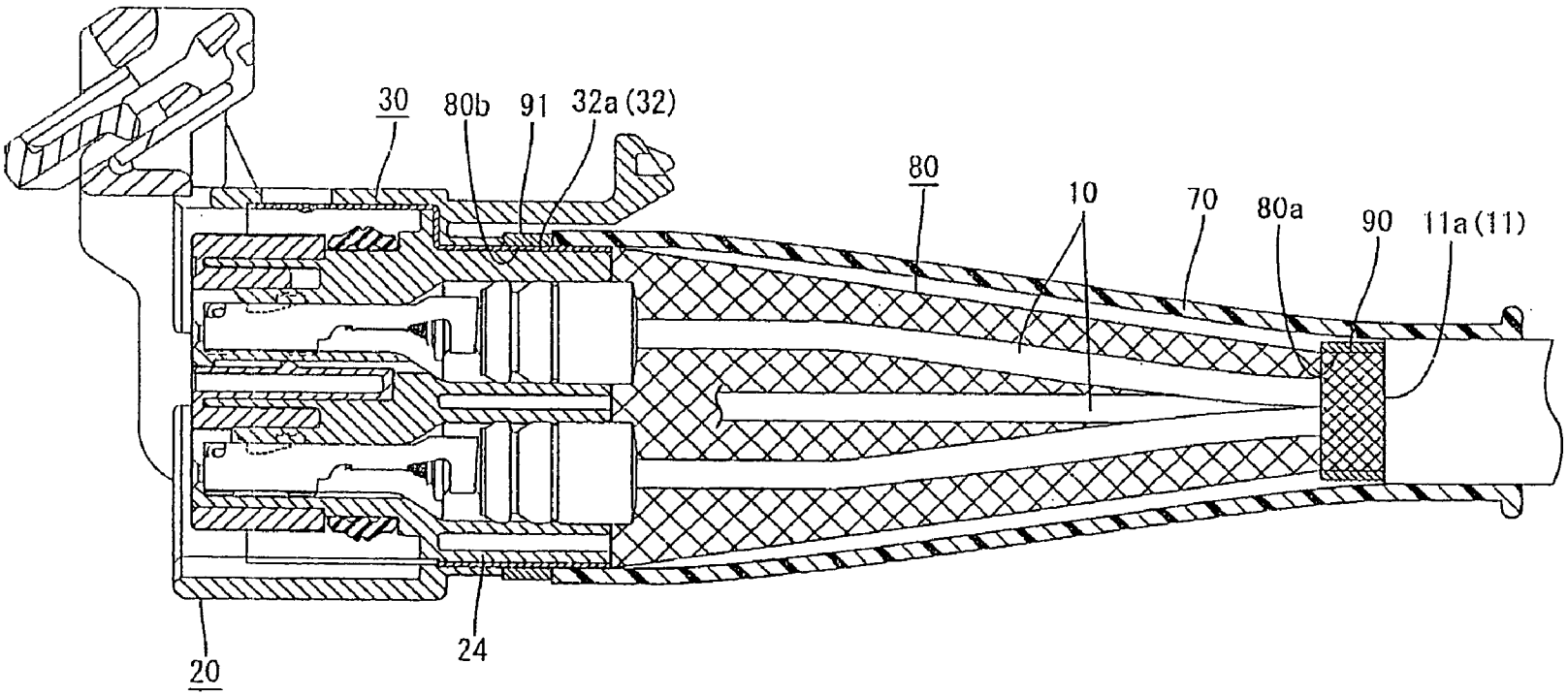
FIG. 19 is a section of a connector of a second embodiment.

A second embodiment of the invention is described with reference to FIG. 19. The metallic tube 50 and the cover 60 shown in the first embodiment are omitted from the second embodiment. Instead, the shield 11 and the shielding shell 30 are connected by a shielding jacket 80. In the second embodiment, no repetitive description is given on the construction, functions and effects similar to those of the first embodiment.

A rear end of the fitting portion 24 of the housing 20 radially out from the round tube 32 of the shielding shell 30 is bored to a specified depth over the entire circumference. Thus, the outer circumferential surface of the rear end of the round tube 32 is exposed to the outside. The fitting tube 25 shown in the first embodiment is omitted and, accordingly, the length of the round tube 32 of the shielding shell 30 is shortened and the resilient contact pieces 34 shown in the first embodiment also are omitted.

The shielding jacket 80 is a tubular element formed by braiding metallic fine wires, and has open front and rear ends. The shielding jacket 80 surrounds all wires 10. A rear end 80*a* of the shielding jacket 80 is fit around a front end 11*a* of the shield 11. A first metal crimping ring 90 then is mounted around the rear end 80*a* of the shielding jacket 80 and is crimped to connect the shielding jacket 80 with the shield 11. A metallic receiving ring (not shown) surrounds all of the wires 10 and is provided between the wires 10 and the shield 11 to receive a crimping force while crimping the first crimping ring 90.

A front end 80*b* of the shielding jacket 80 is fit around a rear end 32*a* of the round tube 32 of the shielding shell 30 so that the ends 32*a*, 80*b* are radially over one another. A second metal crimping ring 91 is mounted on the outer circumferential surface of the front end 80*b* of the shielding jacket 80 and is crimped. As a result, the shielding jacket 80 is connects the shielding shell 30 with the shield 11. The rubber boot 70 then is mounted over the outer circumferential surface of the shielding jacket 80.

Figure 20:
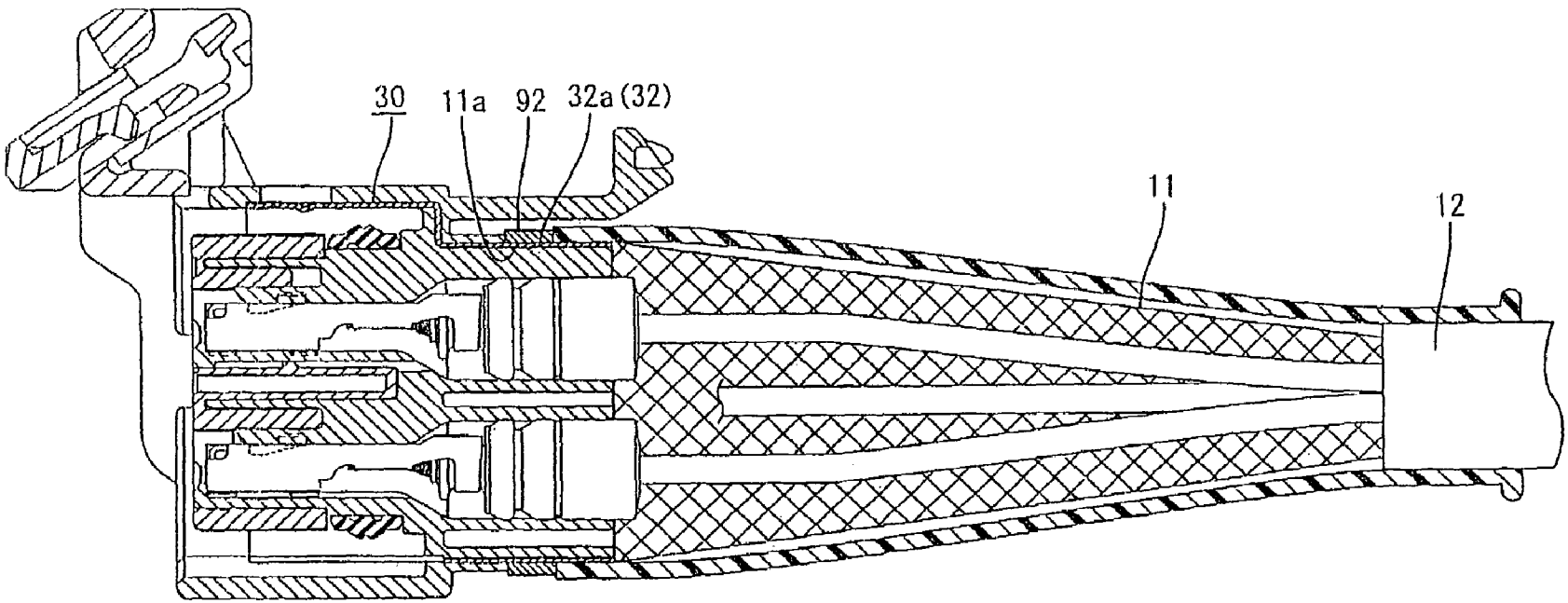
FIG. 20 is a section of a connector according to a third embodiment.
Figure 21:
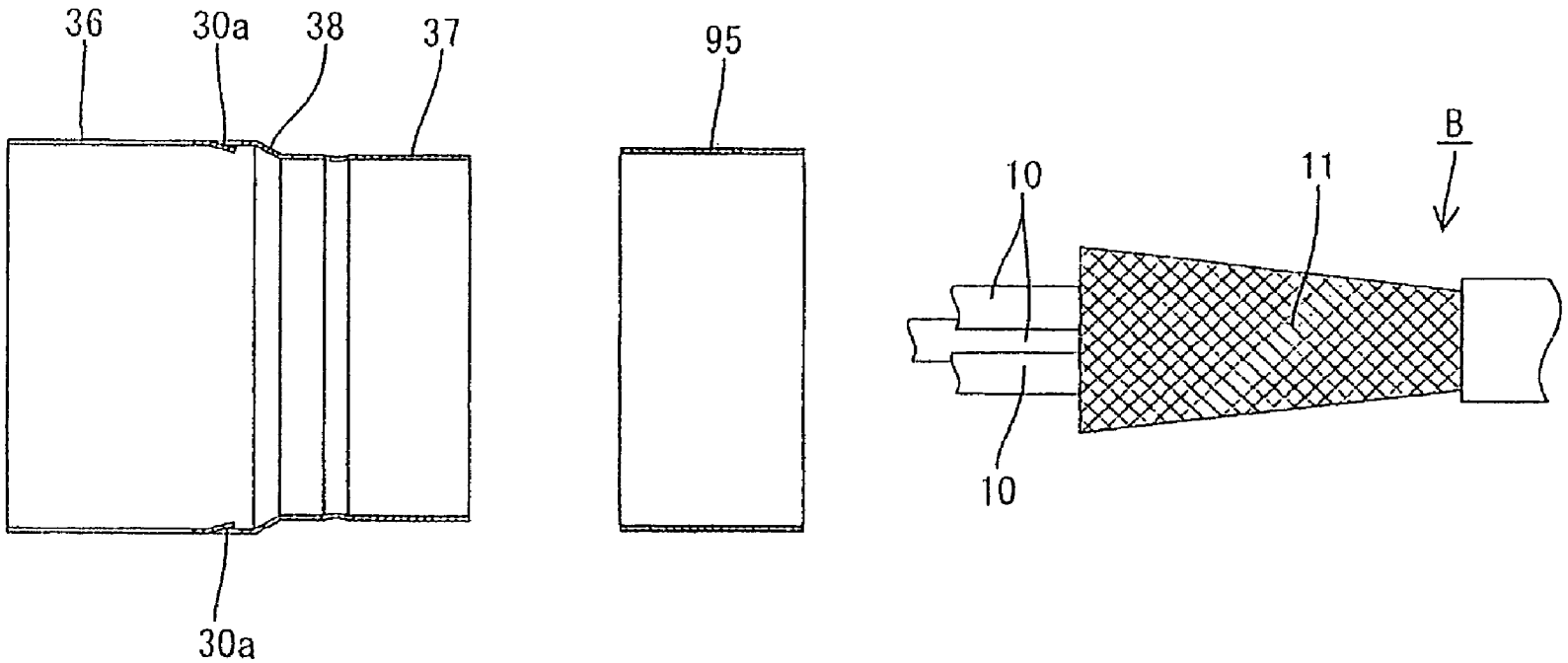
FIG. 21 is an exploded section of a fourth embodiment.
Figure 22:
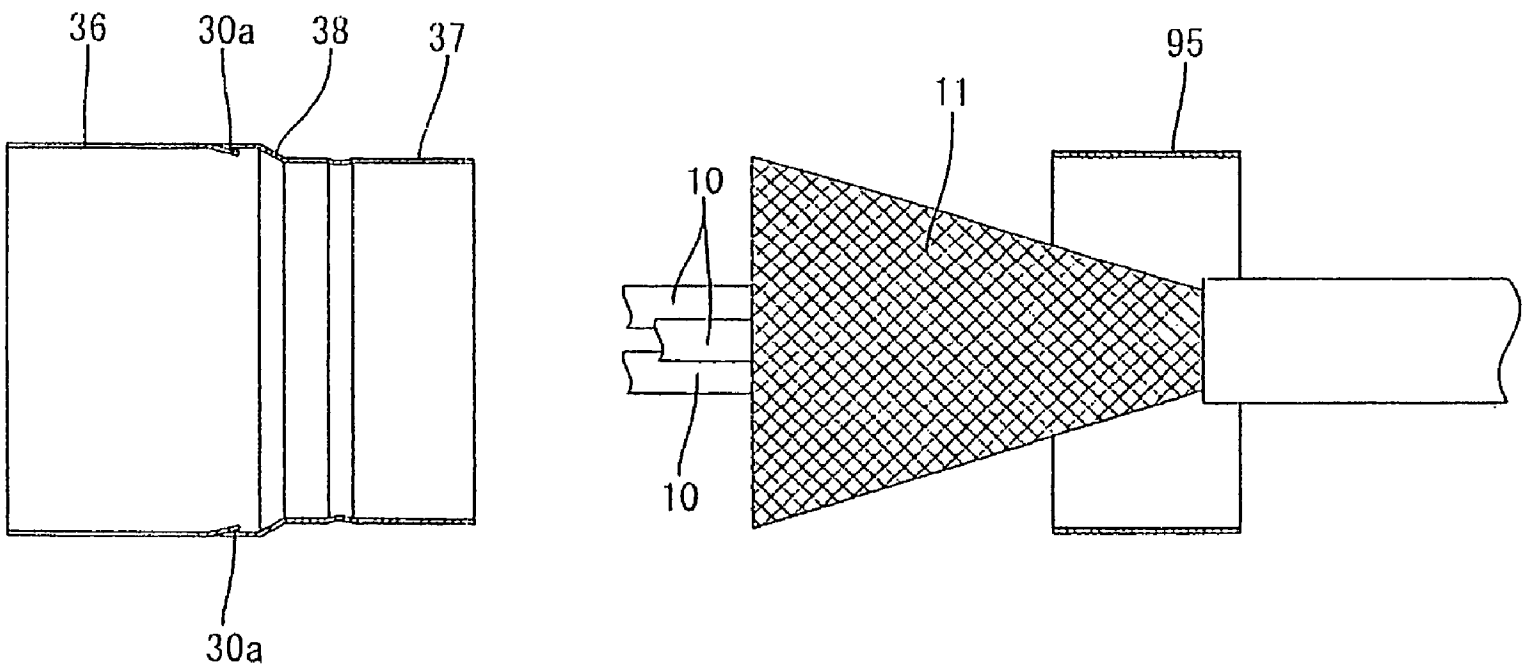
FIG. 22 is a section showing a state before a shielded conductor path is assembled with the shielding shell.

A third embodiment of the invention is described with reference to FIG. 20. In this third embodiment, the shield 11 is connected directly with the shielding shell 30 by omitting the shielding jacket 80 of the second embodiment. In the third embodiment, no repetitive description is given on the construction, functions and effects similar to the first and second embodiments.

A specified length of the sheath 12 is removed to expose the shield 11. The front end 11*a* of the shield 11 then is expanded radially and fit around the rear end 32*a* of the round tube 32 of the shielding shell 30. The metallic crimping ring 92 then is mounted on the outer circumferential surface of the front end 11*a* of the shield 11 and crimped to connect the shield 11 with the shielding shell 30. In this way, the shield 11 is connected directly with the shielding shell 30, and the number of parts can be reduced as compared to the first and second embodiments.

A fourth embodiment of the invention is described with reference to FIGS. 21 to 26. This fourth embodiment is similar to the third embodiment in that the shield 11 is connected directly with the shielding shell 30, but is characterized in that the shielding shell 30 is mounted on the already molded housing 20 from behind. In the fourth embodiment, no repetitive description is given on the construction, functions and effects similar to those of the first to third embodiments.

Figure 23:
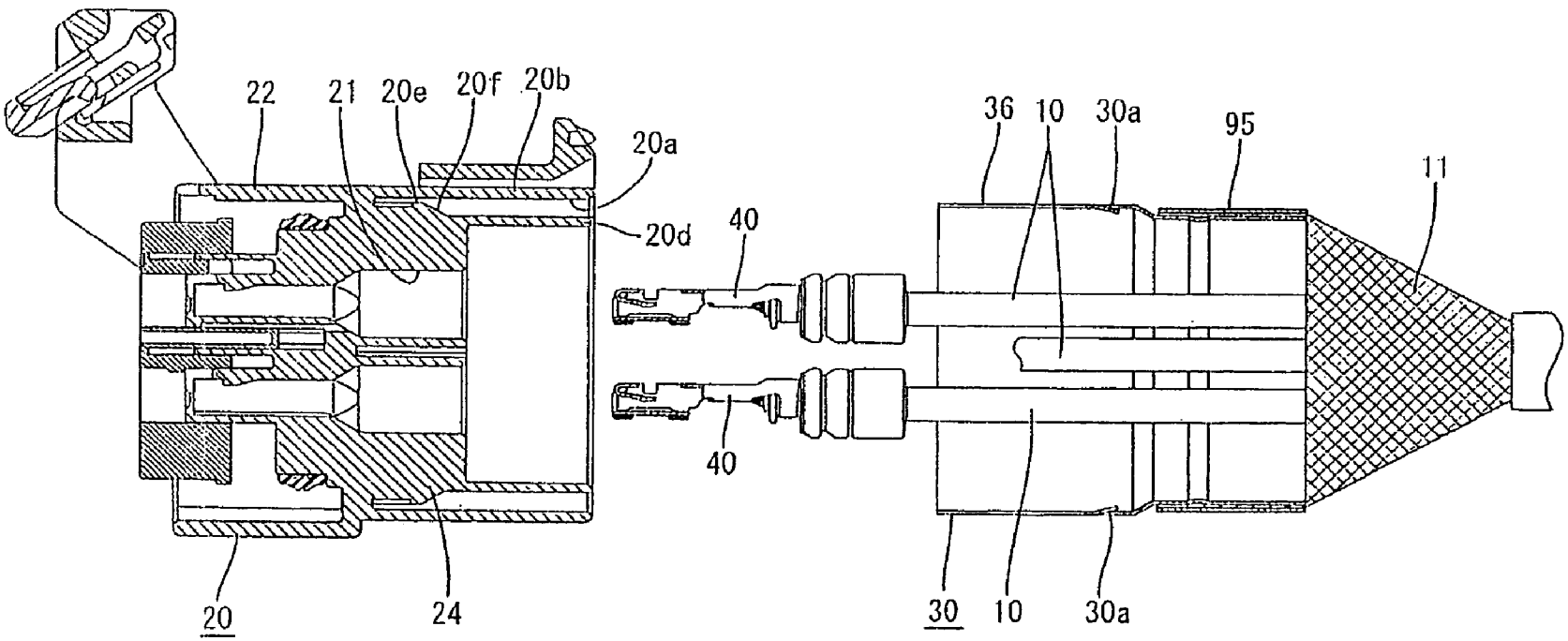
FIG. 23 is a section showing a state before the shielding shell is assembled with the housing.
Figure 24:
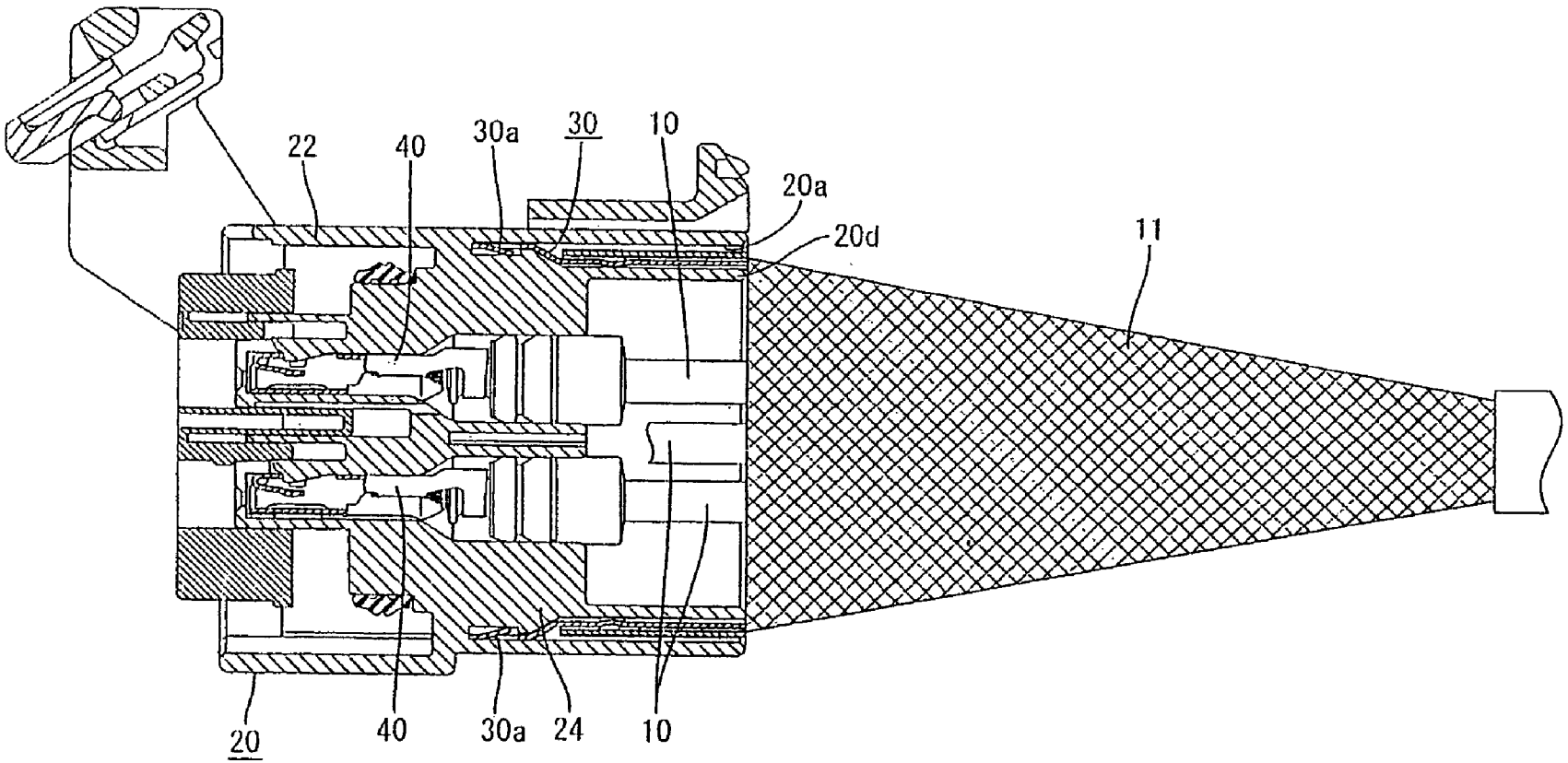
FIG. 24 is a section of an assembled shielded connector of the fourth embodiment.
Figure 25:
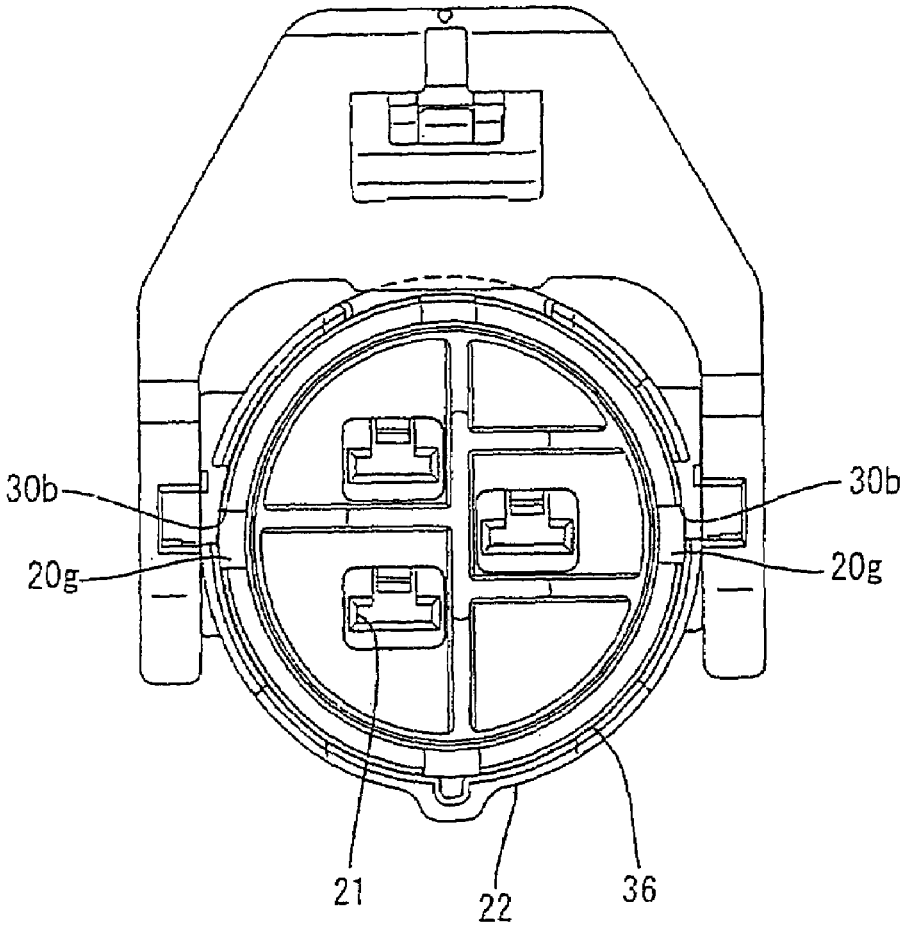
FIG. 25 is a front view of the shielded connector of FIG. 24.
Figure 26:
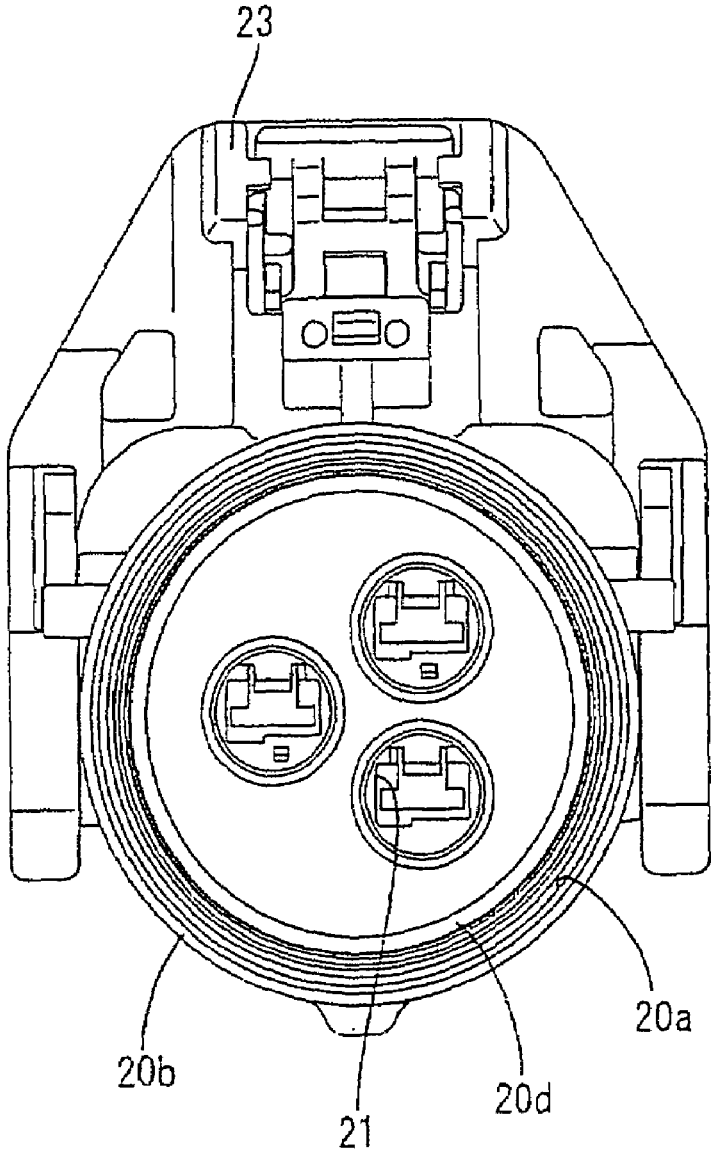
FIG. 26 is a rear view of the shielded connector of FIG. 24.

As shown in FIGS. 23 and 26, the fitting portion 24 of the housing 20 is formed with an annular mounting groove 20*a* for permitting the entrance of the shielding shell 30, and an outer tube 20*b* and an inner tube 20*d* are arranged at a radially outer side and a radially inner side of the mounting groove 20*a*, respectively. The rear ends of the outer tube 20*b* and the inner tube 20*d* are aligned substantially at the same position, and the outer circumferential surface of the outer tube 20*b* is substantially flush with and continuous with the outer circumferential surface of the receptacle 22 except a part of the bottom end.

The inner tube 20*d* is made of the synthetic resin material forming the housing 20, and therefore has an insulating property. The inner tube 20*d* surrounds the wires 10 secured to the respective terminal fittings 10. The insulation coating of one of the wires 10 could be peeled off to expose the conductor. However, the conductor will contact the inner tube 20*d* and avoid a direct contact with the shielding shell 30 fitted into the mounting groove 20*a*. Therefore, no electrical inconvenience occurs. In other words, the inner tube 20*d* is a short-circuit preventing portion.

An engaging portion 20*e* projects from the inner wall of the mounting groove 20*a* at a side of the inner tube 20*d* and has a slanted surface 20*f* sloped down toward the back. Locks 30*a* of the shielding shell 30 are resiliently engageable with the engaging portion 20*e*.

The shielding shell 30 has a large round tube 36 at a front half, and a small round tube 37 at a rear half. The small round tube 37 is concentric with the larger round tube 36. The larger round tube 36 and the smaller round tube 37 are coupled integrally via a tapered step 38.

The inner circumferential surfaces of the larger round tube 36, the step 38 and the smaller round tube 37 are arranged on the outer circumferential surface of the inner tube 20*d* of the fitting portion 24. Thus, the inner circumferential surface of the step 38 closely contacts the slanted surface 20*f* of the engaging portion 20*e*. The end of the shielding member 11 is mounted on the outer circumferential surface of the smaller round tube 37, and a crimping ring 95 is crimped into connection with the shield 11. The length of the crimping ring 95 along forward and backward directions substantially equals the length of the smaller round tube 37 along forward and backward directions.

The larger round tube 36 has circumferentially spaced split slots 30*b* that extend longitudinally from the front end of the larger round tube 36. The housing 20 has engaging projections 20*b* at positions corresponding to the split slots 30*b*. The shielding shell 30 is mounted into the housing 20 so that the engaging projections 20*g* are inserted closely into the slots 30*b* to hinder rotation of the shielding shell 30 about its longitudinal axis.

The locks 30*a* are provided at positions of the larger round tube portion 36 near the step 38. The locks 30*a* are resiliently deformable cantilevers, and arranged at symmetrical positions with respect to the longitudinal axis of the larger round tube 36. Specifically, each lock 30*a* is inclined inward of the larger round tube 36 from the front end to the rear end in its natural state. The locks 30*a* contact the engaging portion 20*e* during the insertion of the shielding shell 30 into the mounting groove 20*a* and deform resiliently out. The locks 30*a* are disengaged when the shielding shell 30 is mounted to a proper depth, and resiliently restored to their initial postures, for engagement with the front surface of the engaging portion 20*e*.

The smaller round tube 37 of the shielding shell 30 is inserted between the wires 10 and the shield 11 prior to assembling the shielding shell 30 into the housing 20. The crimping ring 95 initially is kept on standby at a rear position, but then is slid forward to hold the end of the shield 11 between the smaller round tube 37 and the crimping ring 95. The crimping ring 95 then is crimped by unillustrated upper and lower molds so that the front end of the shield 11 is squeezed between the smaller round tube 37 and the crimping ring 95. Subsequently, as shown in FIG. 23, the terminal fittings 40 are secured to the front ends of the respective wires 10. In this way, an integral unit of the shielding shell 30 and the shielded conductor path B is obtained.

The shielding shell 30 is assembled into the housing 20 by inserting the terminal fittings 40 into the respective cavities 21 and then moving the shielding shell 30 forward to fit the larger round tube 36 into the mounting groove 20*a* of the housing 20. The engaging projections 20*g* of the housing 20 enter the split slots 30*b* of the larger round tube 36 as the larger round tube 36 is pushed deeper into the housing 20. The step 38 then contact the slanted surface 20*f* of the housing 20 to prevent any further forward movement of the larger round tube 36. The locks 30*a* of the shielding shell 30 resiliently engage the engaging portion 20*e* of the housing 20 at the properly mounted position shown in FIG. 24, and the shielding shell 30 is held so as not to come out backward. The cover 60 then is assembled and the rubber boot 70 is mounted as described in the first embodiment.

As described above, the end of the shielding member 11 is secured to the shielding shell 30 before the shielding shell 30 is mounted into the housing 20. It is not necessary to process the end of the shielded conductor path B and connect the shielded conductor path B and the shielding shell 30 at an assembling site, thereby reducing an operation load at the assembling site.

Further, the shielding shell 30 is held in the housing 20 by the resilient engagement of the locks 30*a* of the shielding shell 30 and the engaging portion 20*e* of the housing 20. Thus, the shielding shell 30 is mounted into the housing 20 through a one-touch operation, and it does not take much time to mount the shielding shell 30 into the housing 20.

The invention is not limited to the above described and illustrated embodiments. For example, the following embodiments are also embraced by the technical scope of the present invention as defined by the claims. Beside the following embodiment, various changes can be made without departing from the scope and spirit of the present invention as defined by the claims.

The metallic tube is used for connecting the end of the shielding member and the shielding shell in the first embodiment. However, the end of the shield may be connected directly with the shielding shell by welding according to the invention.

The shielding shell and the housing are formed integrally by insert molding in the foregoing embodiments. However, the shielding shell may be assembled into an already molded housing according to the present invention.

The shielding shell and the metallic tube are connected so that the circumferential surfaces thereof are opposed to each other in the first embodiment. However, flanges may be formed at ends of the shielding shell and the metallic tube. Thus, the shielding shell and the metallic tube may be connected by bringing the flanges into abutment against each other according to the invention.

Lever-type connectors are described in the foregoing embodiments. However, the invention is also applicable to connectors with no lever.

In the second embodiment, the first crimping ring may be crimped with the rear end of the shielding jacket fit inside the front end of the shielding member.

In the fourth embodiment, the engaging portion of the housing may be resiliently deformable and the locking portions of the shielding shell may be holes into which the engaging portion is fittable.

What is claimed is:

1. A shielded connector (A) to be connected with a shielded conductor path (B) having wires surrounded by a tubular shield made of a braided wire, comprising:

a housing for accommodating terminal fittings connected with ends of the wires;

a metallic shielding shell telescoped into the housing and surrounding the terminal fittings; and a connecting means for connecting an end of the shield with the shielding shell, the connecting means including a crimping ring on an outer circumferential surface of the end of the tubular shield fit on the end of the shielding shell.

2. The shielded connector of claim 1, wherein the shielding shell includes a resilient lock engaged with an engaging portion of the housing for holding the shielding shell in the housing.

3. The shielded connector of claim 1, wherein the housing has an insulating short-circuit preventing portion surrounding the wires inward of the shielding shell.

4. The shielded connector of claim 1, wherein the housing has a rear end for receiving the wires and a front end for connection with a mating connector, the rear end of the housing being formed with an annular mounting groove, the shielding shell having opposite front and rear ends, portions of the shielding shell adjacent the front end being inserted into the mounting groove of the housing.

5. The shielded connector of claim 4, wherein the portions of the shielding shell inserted into the mounting groove are formed with locks that extend unitarily inwardly on the shielding shell, the mounting groove being defined partly by an inner tubular wall, the inner tubular wall being formed with an engaging portion for locked engagement with the locks of the shielding shell.

6. The shielded connector of claim 5, wherein the shielding shell has a tubular rear portion rearward of and unitary with the portions of the shielding shell in the mounting groove, the tubular rear portion being cross-sectionally smaller than the portions of the shielding shell adjacent the front end, the shield being telescoped over the tubular rear portion of the shielded shell and being crimped into engagement with the tubular rear portion by the crimping ring.

7. The shielded connector of claim 6, wherein the shielding shell includes a step between the portions adjacent the front end and the tubular rear portion, the step being engaged with a surface of the housing to limit forward movement of the shielding shell relative to the housing.

8. The shielded connector of claim 7, wherein portions of the shielding shell adjacent the front end have slots engaging projections on the housing to prevent rotation of the shielding shell.

9. The shielding connector of claim 8, wherein locks are rearward of the slots.

* * * * *